United States Patent [19]

Barker

[11] 4,369,850

[45] Jan. 25, 1983

[54] HIGH PRESSURE FLUID JET CUTTING AND DRILLING APPARATUS

[75] Inventor: Clark R. Barker, Rolla, Mo.

[73] Assignee: The Curators of the University of Missouri, Columbia, Mo.

[21] Appl. No.: 173,264

[22] Filed: Jul. 28, 1980

[51] Int. Cl.[3] ..... E21B 10/60

[52] U.S. Cl. ..... 175/393; 175/422; 239/102; 239/227; 239/229; 239/264; 285/136; 285/178; 285/272

[58] Field of Search ..... 285/136, 272, 178; 239/102, 225, 227, 229, 264; 175/107, 393, 422, 339, 340

[56] References Cited

U.S. PATENT DOCUMENTS

| | | | |
|---|---|---|---|
| 2,911,196 | 11/1951 | Cameron et al. | 175/336 |
| 3,077,936 | 2/1963 | Arutunoff | 175/107 |
| 3,232,539 | 2/1966 | Hail | 239/264 |
| 3,653,598 | 4/1972 | Waldrum | 239/229 |
| 3,874,595 | 4/1975 | Rindisbacker | 239/102 |

*Primary Examiner*—William F. Pate, III

*Attorney, Agent, or Firm*—Ray E. Snyder

[57] ABSTRACT

A high pressure fluid jet drilling system operable to produce the same drilling effect as a rotating nozzle, but without utilizing a high pressure rotary seal or coupling. The drilling effect is obtained by mounting a non-rotating drilling nozzle within a rotatable case eccentrically with respect to the axis of rotation of the case.

9 Claims, 7 Drawing Figures

HIGH PRESSURE FLUID JET CUTTING AND DRILLING APPARATUS

BACKGROUND OF THE INVENTION

1. Field of the Invention

This invention relates generally to the field of Boring and Penetrating the Earth and more particularly to methods and apparatus for boring by fluid erosion.

2. Description of the Prior Art

Apparatus for hydraulic mining is well known in the art and generally employs a stream of water roughly equivalent to that ejected from a fire hose. The operation of such a system generally requires a large volume of water to be ejected at relatively low pressure, e.g. 100–200 psi. Such a system works reasonably well in cutting through earth or soft material equivalent to gravel and the like, but is totally ineffective for cutting or drilling through hard rock.

It is possible to drill through very hard rock using only a fine water jet stream if high enough pressures are applied. Apparatus of this latter type is generally described in the patent of Summers, et al., U.S. Pat. No. 4,119,160, entitled "Method and Apparatus for Water Jet Drilling of Rock". The fluid pressure commonly employed in such apparatus is on the order of magnitude of 10,000 psi and may be as high as 25,000 psi or higher.

It is common practice when water jets are used for cutting circular holes in rocks or other geological material to rotate the nozzle which requires a rotary coupling or swivel joint in the fluid conduit that supplies the cutting nozzle. Such rotary couplings must be designed to withstand such exceedingly high pressures and in use have been found to have several disadvantages. In every case, such a coupling consists of a stationary non-rotating member which channels the high pressure fluid into a rotating member. The water or other fluid must pass through a seal of some sort which prevents leakage but still allows for rotation of the nozzle head. This seal is an important component in determining the working pressure and rotational speed at which the device can operate. Frequently the seals burn out or are damaged if the coupling is subjected to a thrust load or a high rate of rotation. This has led to a situation where the rotary coupling frequently is the weak link in such a system and requires frequent maintenance to render the equipment functional. In addition to poor reliability, such devices also have shown significant pressure losses across the coupling.

The deficiencies of high pressure rotary couplings or rotary seals have been recognized by others. In the patent to Bowen, U.S. Pat. No. 3,565,191, a proposed solution was offered by providing a rotary seal at the low-pressure side and a high pressure intensifier within a housing that rotates along with the nozzle.

In addition to the poor reliability of the rotary couplings, significant pressure losses have been measured across such couplings. In an effort to make the seal more effective and thereby increase the possible operating pressure, the size of the fluid channel frequently has been reduced, resulting in a restriction to flow through the coupling. Commercially available couplings have proven to be expensive, unreliable and very limited in hours of operation, working pressure, and flow capacity. In addition, their physical size has been a limitation in designing specific machines. The same limitation would apply to the rotary intensifier of Bowen in the patent above.

SUMMARY OF THE INVENTION

It is an object of the present invention to overcome the deficiencies of an expensive and unreliable rotary coupling in a high pressure water jet system by completely eliminating the rotating coupling and replacing it with an inexpensive and highly reliable mechanical system. More particularly, it is an object to provide a high pressure water jet system having a high velocity, non-rotating, jet nozzle that is wobbled by a rotating mechanical system so as to produce the same drilling effect as a rotating nozzle.

It is an additional object to provide an improved water jet drilling system which eliminates the pressure losses and flow disturbances which are common in commercial rotary couplings.

DESCRIPTION OF THE PREFERRED EMBODIMENT

Figure 1:
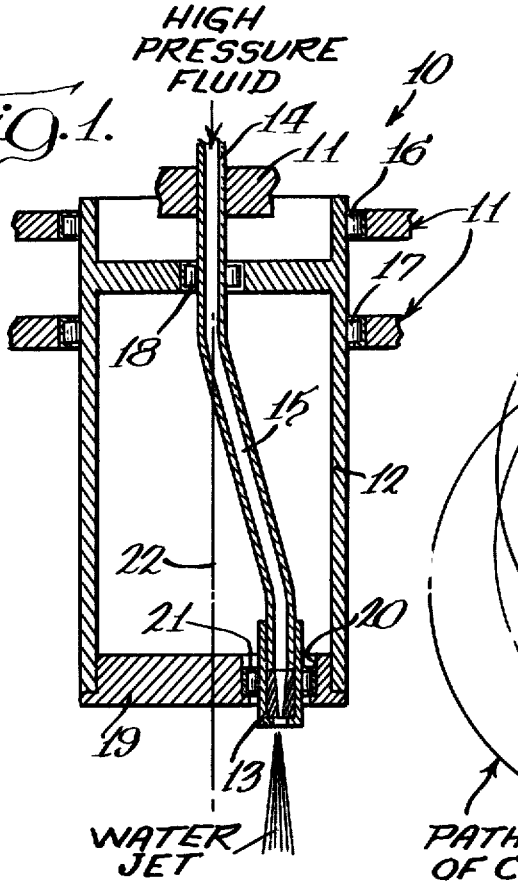
FIG. 1 is a schematic longitudinal sectional view of the improved fluid jet drilling system of the present invention having a rotatable case.

The improved fluid jet drilling system of the present invention is illustrated schematically, not in proportion, in FIG. 1 and is designated as a whole by the numeral 10. The system 10 comprises a main frame 11, a rotatable tubular case 12, a fluid jet nozzle 13 and a fluid supply conduit 14. A flexible extension 15 of the fluid supply conduit 14 is mounted within the case 12 and connects the conduit 14 to the nozzle 13.

The case 12 is in the form of an elongated tube and is mounted for rotation within the main frame 11 by bearings 16 and 17. The case 12 is also journalled for rotation about the supply conduit 14 by a bearing 18. The case 12 has a fixed end wall or cap 19 mounted on the nozzle end thereof and is formed with an offset circular aperture 20. A bearing 21 is mounted within the aperture 20 and surrounds the nozzle 13. The aperture 20 is radially offset from, but axially parallel to a center line or axis 22 of the case 12. The fluid conduit 14 is clamped or otherwise fixedly attached to the main frame 11 and is journalled through the bearing 18. The nozzle 13 is mounted so that the fluid jet ejected therefrom is generally parallel to but radially offset from the axis 22.

Figure 3:
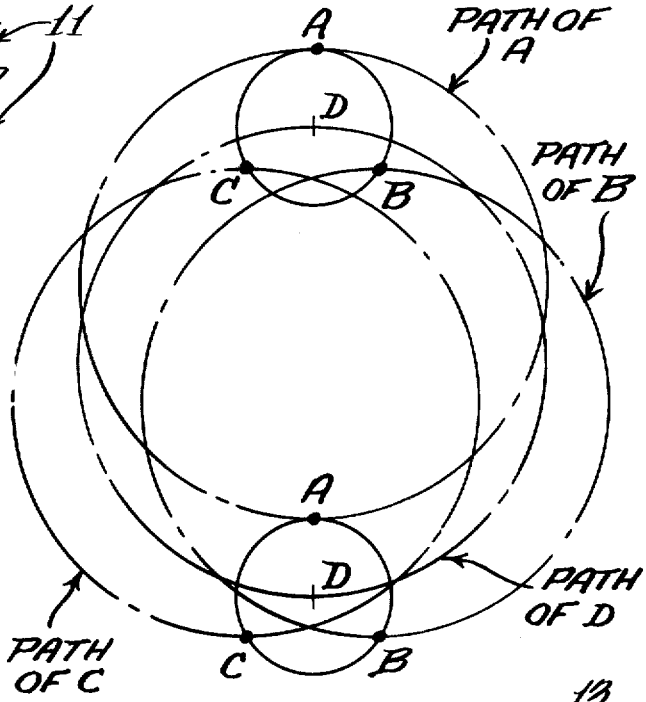
FIG. 3 is a diagram of the path of motion described by fluid jets ejected from the nozzle.

In operation, as the case 12 rotates about the axis 22, the tube 15 is caused to flex or deform slightly to accommodate for the eccentric motion of the nozzle 13. The tubular case 12 is held in place by the bearings 16 and 17 which provide for rotation and also absorb any normal thrust loads transmitted to it. When the tubular case 12 is caused to rotate, the resulting orbiting or wobbling motion of the nozzle 13 and the jet ejected therefrom is illustrated in FIG. 3. It can be seen that at specified points, the nozzle jet executes a circular path, but the nozzle 13 and supply pipe 14 never rotate relative to the machine frame 11.

The configuration of FIG. 1, when fitted with a fluid jet cutting nozzle 13 of proper design to cut a hole slightly larger than the outside diameter of the rotating tubular case 12, can be used for boring or drilling holes of any length in geological material.

Figure 2:
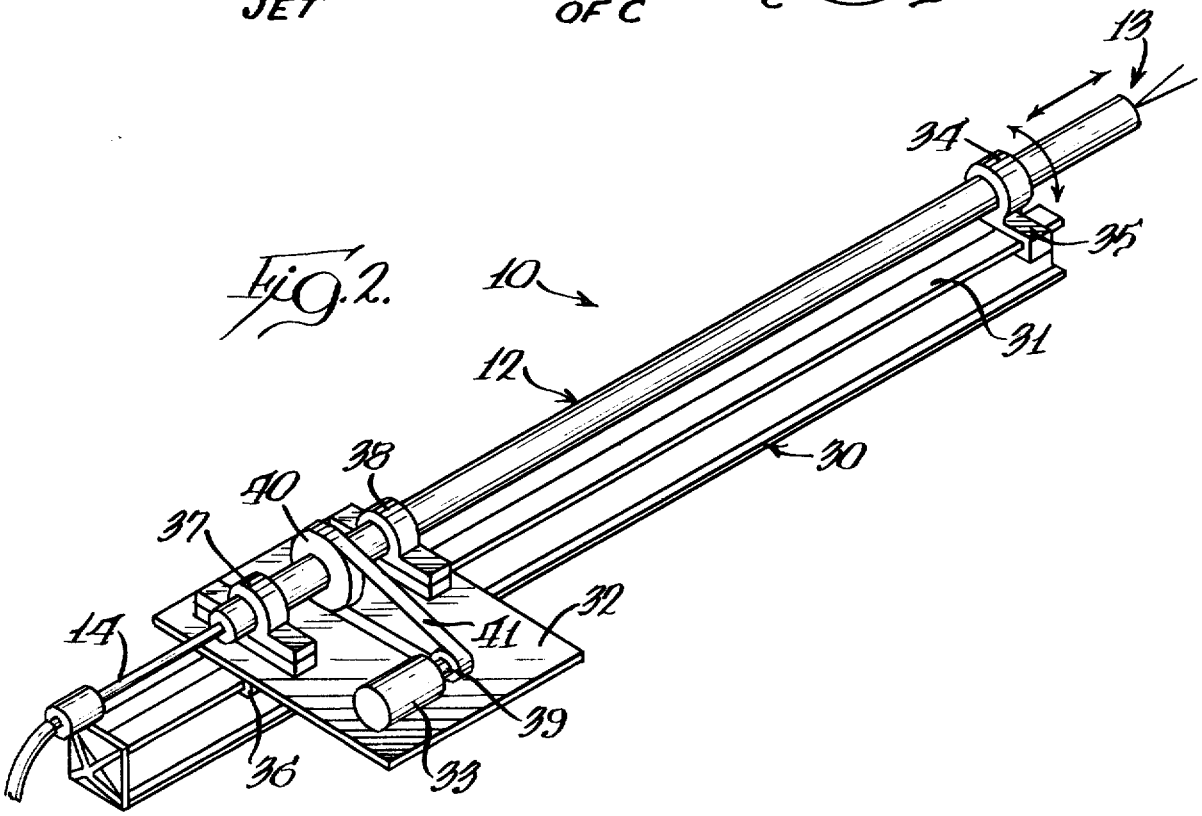
FIG. 2 is an external perspective view of the complete drilling apparatus.

Referring now to FIG. 2 there is illustrated a perspective view of the improved drilling apparatus of the present invention, generally in scaled physical proportion. The apparatus is designated as a whole by the numeral 10 and comprises the rotatable case 12, a guide rail 30 having a flange or flanges 31, a drive plate 32 and a hydraulic drive motor 33. A journal box 34 surrounds the case 12 and is mounted or formed integrally with a guide block 35 mounted on the flange 31. The drive plate 32 is mounted on one or more guide blocks 36 also supported on the flange 31. A pair of journal boxes 37 and 38 are mounted on top of the drive plate 32 along with the hydraulic motor 33. The hydraulic motor 33 has a drive pulley 39 and a driven pulley 40 surrounds and is attached to the case 12. A belt 41 forms a driving connection between the pulleys 39 and 40.

In operation, the conduit 14 is connected to a high pressure supply line and delivers fluid under pressure through the tube 15 within the case 12 to the nozzle 13 at the free end of the case 12. The hydraulic motor 33 is energized and the belt 41 drives the pulley 40 and tubular case 12 causing it to rotate within the journal boxes 34, 37 and 38. The water jet from the nozzle 13 is directed to impact on the surface to be drilled or cut. Rotation of the tubular case 12 produces eccentric circular motion of the nozzle 13 as previously described. As the hole is drilled in the geological structure, the drive plate and tubular case 12 are caused to advance in the direction of the jet by a suitable drive means (not shown). The guide blocks 36 supporting the drive plate 32 are disposed to slide along the rail 30 as the system advances. The journal box 34 and the guide block 35 can be fixedly mounted on the rail 30, or can be permitted to slide along the flange 31 within a limited degree of motion. The journal box 34 and block 35 may also form a lost-motion connection with the rail 30 in that it can be permitted to slide along the rail 30 until it reaches the end, and the tubular case is then permitted to advance through the journal box 34.

Figure 4:
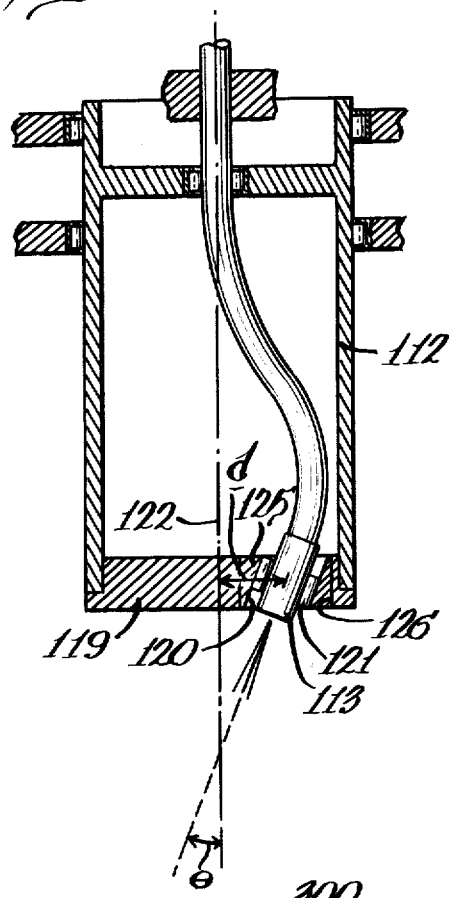
FIG. 4 is a schematic longitudinal sectional view of a modification to the system of FIG. 1 in which the fluid jet is inclined at an angle to the center line of rotation of the case.

Referring now to FIG. 4, there is illustrated a modified embodiment of the invention in which a rotatable drilling case 112 carries a drilling nozzle 113 mounted in an end cap 119 so as to be inclined at an angle $\theta$ with respect to an axis or rotation 122. The nozzle is mounted so as to be offset at a distance "d" from the axis 122. The jet stream ejected from the nozzle 113 is oriented to intersect and cross the axis 122 and executes a conical path as the case 112 is rotated. A bearing support 121 surrounds the nozzle 113 and is contained within an aperture 120. The aperture 120 and bearing support 121 may be formed in a replaceable collar or plug 125 adapted to be screwed or otherwise mounted within a fixed aperture 126 formed in the end cap 119. This would permit use of a plurality of replacement plugs 125 to establish a desired angle of inclination $\theta$ for the particular material being drilled or for the drilling conditions encountered. The conical path executed by the water jet being directed across the axis 122 ensures that all of the material being cut will be removed from in front of the end plate 119. The direction of the water jet can also be adjusted to cut additional clearance outside of the body of the rotating case 112 if necessary.

Figure 5:
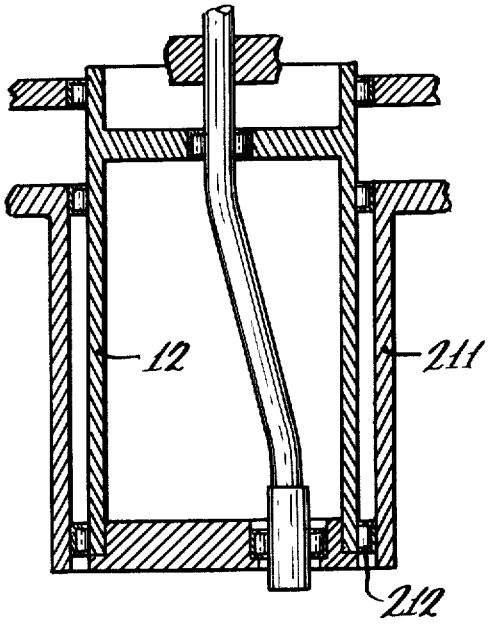
FIG. 5 is a schematic view of a modification to the system of FIG. 1 wherein a non-rotating case has been fitted around the outside of the rotating case.

Referring now to FIG. 5, there is illustrated still another modification of the invention in which a non-rotating case 211 is fitted around the outside surface of the rotating case 12. An additional bearing 212 may be provided between the outer surface of the rotating case 12 and the inner surface of the non-rotating case 211. The object of this modification is to shield the rotating case 12 from possible abrasion which could result when cuttings pass along the outside of the case 12. This embodiment also prevents direct frictional contact of the rotating case 12 against the side of the hole or slot previously cut by the fluid jet.

Figure 6:
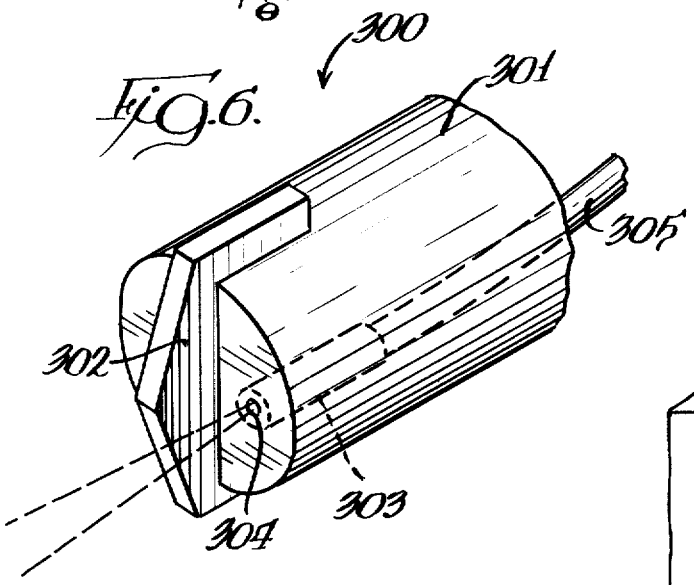
FIG. 6 is a schematic perspective embodiment wherein the principles of the present invention have been incorporated into a conventional drag bit drill.

The principles and apparatus of the present invention can also be used to augment the performance of conventional devices used for drilling and rock cutting. Referring now to FIG. 6, there is illustrated a phantom embodiment into a conventional drag bit drill designated by the number 300. The drill 300 comprises a rotatable tube 301 formed with a cutting drag bit 302 on one end thereof. A cutting nozzle 303 is mounted within the tube 301 and ejects a high velocity water jet through an orifice 304 formed in the end of tube 301. The direction of the water jet is generally parallel to the axis of the rotating tube 301 in advance of the direction of the motion drill 300, although the jet stream can be directed as desired to further enhance the drilling. The nozzle 303 is attached to a non-rotating supply pipe 305 and is supported within the rotating tube 301 by suitable bearing means not shown. It should be noted in this embodiment that the high pressure water jet serves to augment the cutting action of the drill 300 and differs significantly from conventional drilling bits in which water or other fluid is directed to the cutting teeth for cooling the same and for flushing away debris removed by the cutting edges.

Figure 7:
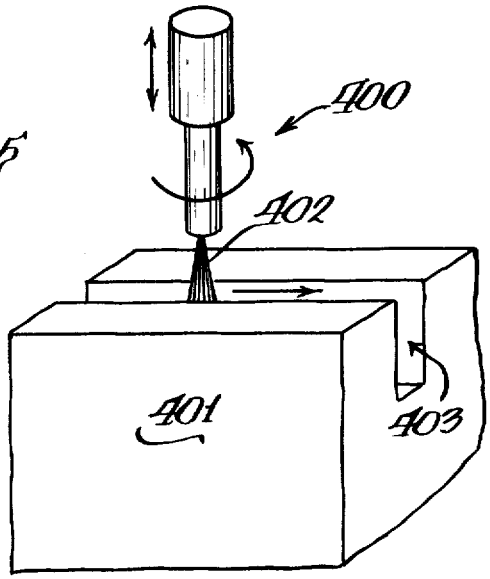
FIG. 7 is an external perspective view of the apparatus mounted for cutting slots in rock or other material.

Referring now to FIG. 7, there is illustrated still another embodiment in which the principles and apparatus of the present invention can be utilized for cutting slots in rock or other materials. In this embodiment the high pressure water jet system is designated by the numeral 400 and is mounted over a sample block 401 to be cut. The water jet 402 is directed to impinge against the surface of the material of block 401 and is effective to cut a slot 403 therein. The cutting system 400 can be mounted on a suitable carriage (not shown) so as to be moved horizontally over the sample 401. Alternatively, the cutting system 400 can be relatively fixed and the sample block 401 moved transversly with respect to the water jet 402. This mounting system can also be designed to advance the nozzle into the slot 403 so as to cut to a greater depth in successive passes. The slot cutting or drilling effect can also be accomplished by using a dual or multiple orifice nozzle for more complete areal coverage if the material requires this action. Coverage of the material to be cut can also be enhanced by oscillating the apparatus along an axis perpendicular to the material being cut as illustrated in FIG. 7.

There has been provided by this invention an improved method and apparatus whereby high pressure water or other fluid is conducted to a fluid jet cutting nozzle which executes a "simulated rotating" motion without the necessity for a rotating coupling or swivel joint to be included in the system. The arrangement shown in FIG. 1 requires that the supply pipe 15 within the tube 12 be deformed continuously as the outer tubular case rotates, but the supply pipe 15 itself is non-rotating, except for the orbiting motion executed near the nozzle 12. The supply pipe 15 could be replaced with a section of flexible hose of the type commonly used in high pressure water jet blasting work. The most significant advantage of this invention is that an expensive and unreliable rotary coupling can be completely eliminated and replaced with an inexpensive and highly reliable mechanical system. The life of the apparatus shown and described should be very long and potentially maintenance free since there are no seals to wear and require replacement.

It is to be understood that the embodiments shown and described are the preferred ones and that many changes and modifications may be made thereto without departing from the spirit of the invention. The invention is not to be considered as limited to these embodiments except insofar as the claims may be so limited.

I claim:

1. A high pressure fluid jet drilling and cutting system adapted to be connected to a source of high pressure fluid, and comprising:

a fluid jet nozzle for ejecting a high velocity fluid jet stream;

a non-rotating fluid supply conduit interconnecting said nozzle with said source of high pressure fluid; and eccentric drive means including a rotatable cylindrical shell surrounding said conduit attached to said nozzle and operable to move said nozzle in a general circular path without rotating said nozzle with respect to said supply conduit.

2. The system of claim 1 wherein:

said supply conduit includes a deformable section near said nozzle which can flex under the influence of said eccentric drive means.

3. The system of claim 1 wherein:

said eccentric drive means includes a rotatable tubular case having a longitudinal axis of rotation and wherein said nozzle is mounted within said case and radially offset from said axis.

4. The system of claim 3 wherein:

said tubular case has an axial end wall formed with a radially offset aperture through which said nozzle extends.

5. The system of claim 4 including:

a bearing mounted within said aperture for supporting said nozzle.

6. The system of claim 5 wherein:

said nozzle is mounted through said aperture with said jet stream directed at some desired angle with respect to said axis of rotation.

7. The system of claim 6 including:

a replaceable plug surrounding said nozzle and mounted within said aperture.

8. The system of claim 3 including:

a non-rotatable tubular case surrounding and protecting said rotatable tubular case.

9. The drilling system of claim 1 wherein:

said rotatable cylindrical shell has an end wall mounted thereon formed with an aperture that is radially offset from the axis of said shell;

a cutting bit mounted on the exterior of said end wall; and said fluid jet nozzle is rotatably mounted within said aperture and directed to eject a high velocity jet stream in the direction of advance of said cutting bit, whereby said nozzle does not rotate as said shell rotates.

* * * * *

REEXAMINATION CERTIFICATE (1073rd)

United States Patent [19]

Barker

[11] B2 4,369,850

[45] Certificate Issued Jun. 6, 1989

[54] HIGH PRESSURE FLUID JET CUTTING AND DRILLING APPARATUS

[75] Inventor: Clark R. Barker, Rolla, Mo.

[73] Assignee: The Curators of the University of Missouri, Columbia, Mo.

Reexamination Request:
No. 90/001,663, Dec. 12, 1988

Reexamination Certificate for:

| | |
|---|---|
| Patent No.: | **4,369,850** |
| Issued: | **Jan. 25, 1983** |
| Appl. No.: | **173,264** |
| Filed: | **Jul. 28, 1980** |

Reexamination Certificate B1 4,369,850 issued Jul. 12, 1988.

[51] Int. Cl.[4] ..... E21B 10/60

[52] U.S. Cl. ..... 175/393; 175/424; 239/102.1; 239/227; 239/229; 239/264; 285/136; 285/272; 285/178

[56] References Cited

U.S. PATENT DOCUMENTS

| | | | |
|---|---|---|---|
| 629,539 | 7/1899 | Bertram | 175/18 |
| 1,089,525 | 3/1914 | Bignell | 405/248 |
| 1,092,075 | 3/1914 | Monberg | 175/393 |
| 1,574,439 | 2/1926 | Pringle | 405/248 |
| 3,393,756 | 7/1968 | Mori | 175/258 |
| 3,924,698 | 12/1975 | Juvkam-Wold | 175/193 |

*Primary Examiner*—Thuy M. Bui

[57] ABSTRACT

A high pressure fluid jet drilling system operable to produce the same drilling effect as a rotating nozzle, but without utilizing a high pressure rotary seal or coupling. The drilling effect is obtained by mounting a non-rotating drilling nozzle within a rotatable case eccentrically with respect to the axis of rotation of the case.

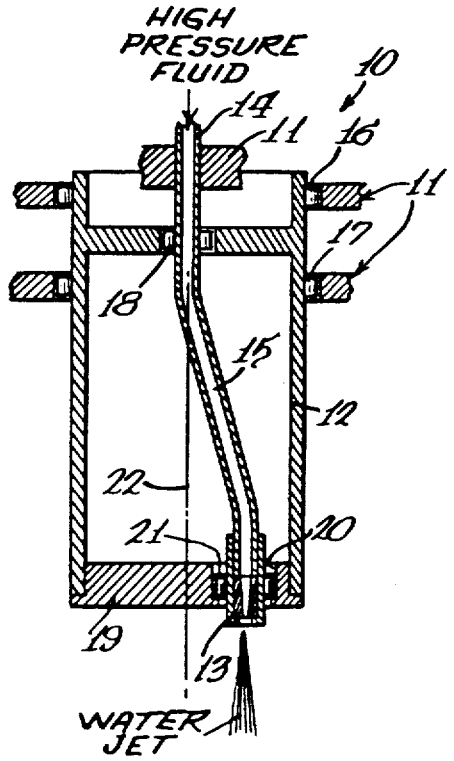

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 10–16 is confirmed.

Claims 1–9 were previously cancelled.

* * * * *